United States Patent [19]

Hoberman

[11] Patent Number: 5,024,031

[45] **Date of Patent: * Jun. 18, 1991**

[54] RADIAL EXPANSION/RETRACTION TRUSS STRUCTURES

[76] Inventor: Charles Hoberman, 472 Greenwich St., New York, N.Y. 10013

[ * ] Notice: The portion of the term of this patent subsequent to Sep. 4, 2007 has been disclaimed.

[21] Appl. No.: 505,804

[22] Filed: Apr. 6, 1990

Related U.S. Application Data

[63] Continuation-in-part of Ser. No. 263,582, Oct. 27, 1988, Pat. No. 4,942,700.

[51] Int. Cl.[5] ..... E04B 1/32; E04B 1/00

[52] U.S. Cl. ..... 52/81; 52/109; 52/646

[58] Field of Search ..... 52/109, 646, 81; 135/25 R

[56] References Cited

U.S. PATENT DOCUMENTS

| | | | |
|---|---|---|---|
| 23,503 | 4/1859 | Selden | 135/25 R |
| 1,255,182 | 2/1918 | Krapski | 135/25 R |
| 3,174,397 | 3/1965 | Sanborn | 52/109 |
| 3,496,687 | 2/1970 | Greenberg | 52/109 |
| 3,672,104 | 6/1972 | Lackey | 52/109 |
| 3,700,070 | 10/1972 | King | 52/109 |
| 3,888,056 | 6/1975 | Kelly | 52/109 |
| 3,968,808 | 7/1976 | Zeigler | 52/109 |
| 4,026,313 | 5/1977 | Zeigler | 52/109 |
| 4,290,244 | 9/1981 | Zeigler | 52/109 |
| 4,437,275 | 3/1984 | Zeigler | 52/109 |
| 4,689,932 | 9/1987 | Zeigler | 52/109 |

FOREIGN PATENT DOCUMENTS 1921812 11/1970 Fed. Rep. of Germany .... 135/25 R

*Primary Examiner*—Henry E. Raduazo

*Attorney, Agent, or Firm*—Sprung Horn Kramer & Woods

[57] ABSTRACT

A loop-assembly is disclosed which is comprised of at least three scissors-pairs, at least two of the pairs comprising:

two essentially identical rigid angulated strut elements, each having a central and two terminal pivot points which do not lie in a straight line, each strut being pivotally joined to the other of its pair by their central pivot points, each pair being pivotally joined by two terminal pivot points to two terminal pivot points of another pair such that both scissors pairs lie essentially in the same plane, or each pair being pivotally joined by two terminal pivot points to two terminal pivot points of another pair in that the terminal points of a scissors-pair are each pivotally joined to a hub element, and these hub elements are in turn joined to the terminal pivot points of another scissors-pair, whereby a closed loop-assembly is thus formed of scissors pairs, and this loop-assembly can fold and unfold, and a line that intersects and is perpendicular to the axes of any two terminal pivot points is non-parallel with at least two other similarly formed lines in the assembly, the angles formed between said lines remaining constant as the loop assembly is folded and unfolded.

24 Claims, 12 Drawing Sheets

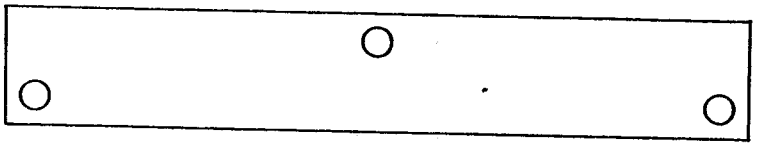
FIG.IB
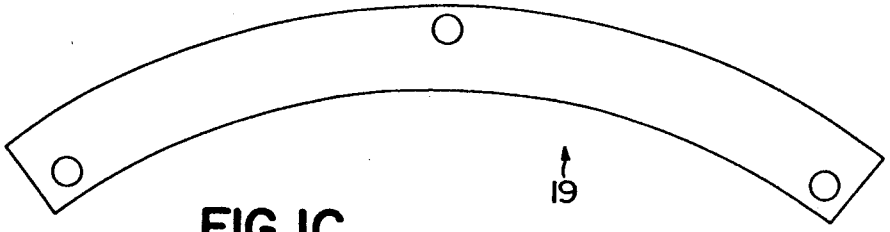
FIG.IC
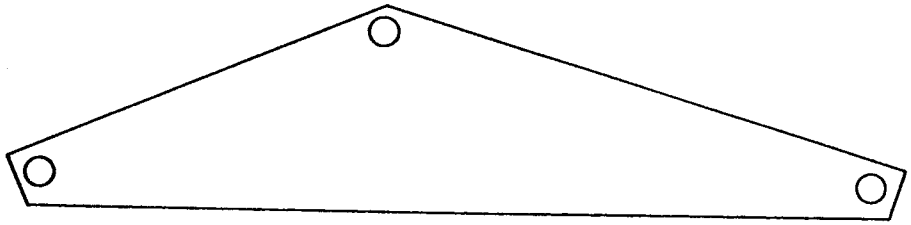
FIG.IA

FIG. 24
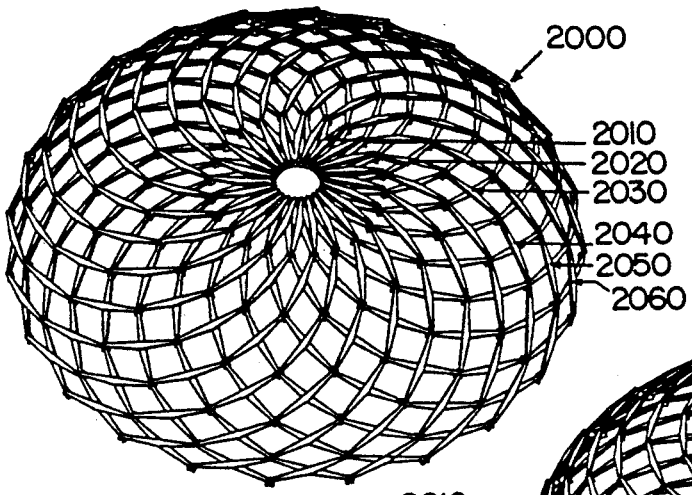
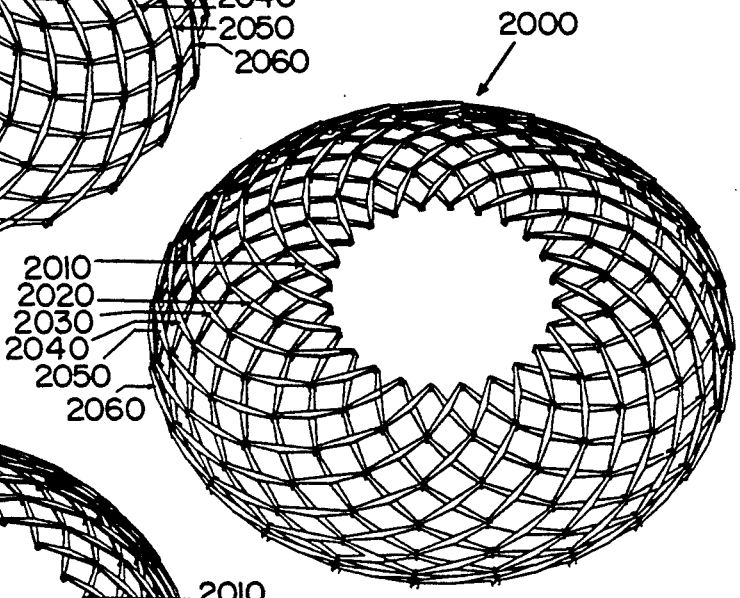
FIG. 25
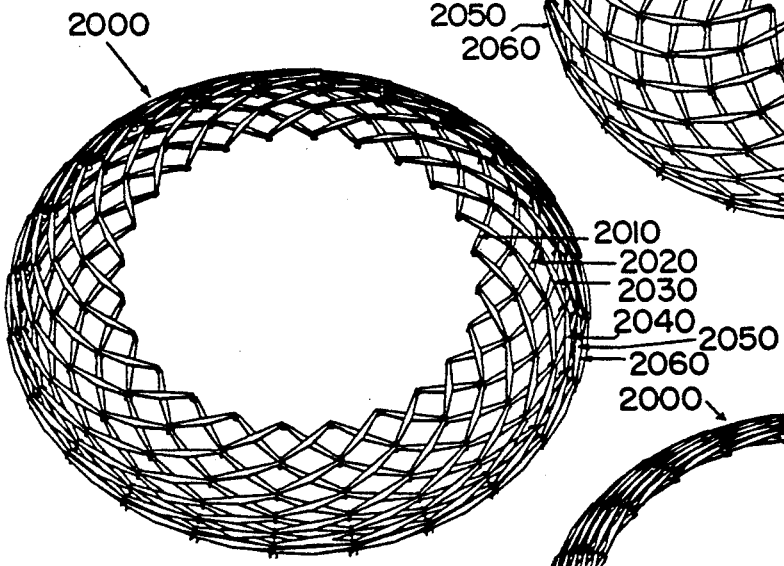
FIG. 26
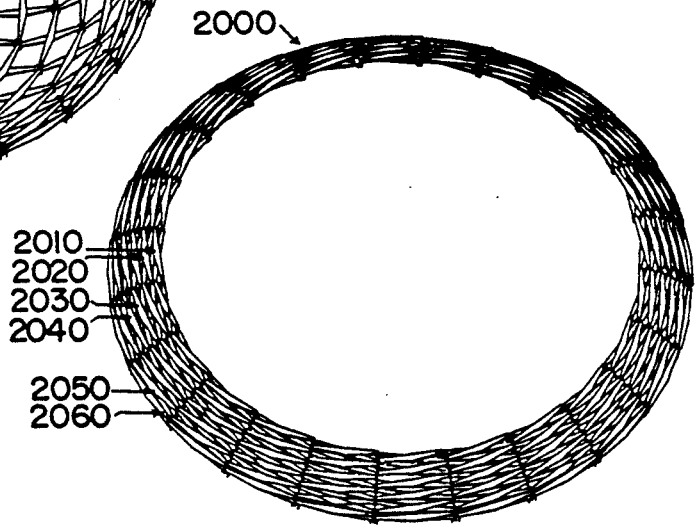
FIG. 27

RADIAL EXPANSION/RETRACTION TRUSS STRUCTURES

This is a continuation-in-part of application Ser. No. 263,582, filed Oct. 27, 1988, now U.S. Pat. No. 4,942,700.

BACKGROUND OF THE INVENTION

Structures that transform in size or shape have numerous uses. If one desires to have a portable shelter of some kind, it should package down to a compact bundle (tents being a prime example).

I have discovered a method for constructing reversibly expandable truss-structures that provides for an extremely wide variety of geometries. Trusses formed by this method will collapse and expand in a controlled, smooth and synchronized manner. Such structures require no complex joints. Connections are limited to simple pivots. A unique characteristic of one embodiment of the present invention is that it provides a three-dimensional folding truss whose overall shape and geometry is constant and unchanging during the entire folding process. Only its size changes between a compact bundle and an extended self-supporting structure.

There are times when, rather than desiring a portable shelter, one wishes to have a structure that remains fixed to a site, but that can open and close. An example is a retractable roof over a stadium, swimming pool, theater or pavilion.

An alternate embodiment of the present invention provides reversibly retractable structures that open up from the center outwards, but maintain an essentially fixed perimeter. The kind of motion exhibited by such structures may be described as an iris-type motion.

The structure is a truss consisting of links joined by simple pivots. Coverings may be provided in various ways, such as attaching shingled plates or a flexible membrane to the truss.

In addition to retractable roofs, numerous other uses exist for this embodiment of the invention. Novel window shades, toys and special irises for lighting are examples.

BRIEF SUMMARY OF THE INVENTION

The present invention allows for self-supporting structures that maintain their overall curved geometry as they expand or collapse in a synchronized manner. An alternate embodiment of the invention allows for iris-type retractable structures, where the center of the structure retracts towards its perimeter. In this embodiment the perimeter maintains a nearly constant size.

Structures of either embodiment are comprised by special mechanisms hereinafter referred to as loop-assemblies. These assemblies are in part comprised by angulated strut elements that have been simply pivotally joined to other similar elements to form scissors-pairs. These scissors-pairs are in turn simply pivotally joined to other similar pairs or to hub elements forming a closed loop.

When this loop is folded and unfolded certain critical angles are constant and unchanging. These unchanging angles allow for the overall geometry of structure to remain constant as it expands or collapses.

BRIEF DESCRIPTION OF THE DRAWING FIGURES

The invention will be further described with reference to the accompanying drawings, wherein:

FIGS. 1A–1C are plan views of alternate configurations of the basic element, also being angulated with regards to their pivot points, if not their outer shape;

FIG. 2A is a perspective view of the scissors-pair;

FIGS. 24–27 show a sequence of views of another iris-type retractable structure that has a domed form;

DETAILED DESCRIPTION

Figure 1:
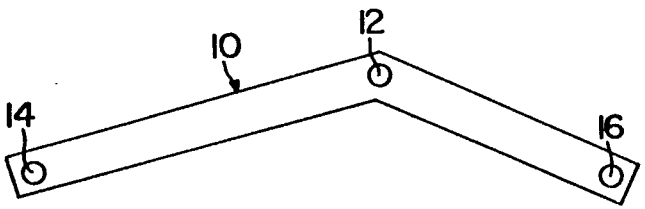
FIG. 1 is a plan view showing the basic angulated strut element that largely comprises the structure.

Referring now more particularly to the drawings, in FIG. 1 there is shown an essentially planar rigid strut element 10 which contains a central pivot point 12 and two terminal pivot points 14 and 16 through which pass three parallel axes. The centers of the aforesaid three pivot points do not lie in a straight line; the element is angulated. The distance between points 14,12 and the distance between 16,12 may be each be arbitrarily chosen. The angle between the line joining points 14,12 and the line joining points 16,12 may be arbitrarily chosen. Said angle will hereinafter be referred to as the strut-angle.

In FIG. 1A there is shown another configuration 17 of a basic strut element. It is similar in all essential aspects to that shown in FIG. 1, save that it has a triangular rather than angulated outer shape. FIGS. 1B and 1C show respectively strut elements 18 and 19. They are essentially similar to that shown in FIG. 1, save for the outer shape. The strut elements shown in FIGS. 1A–1C are all angulated with regards to the placement of their three pivot points.

Figure 2:
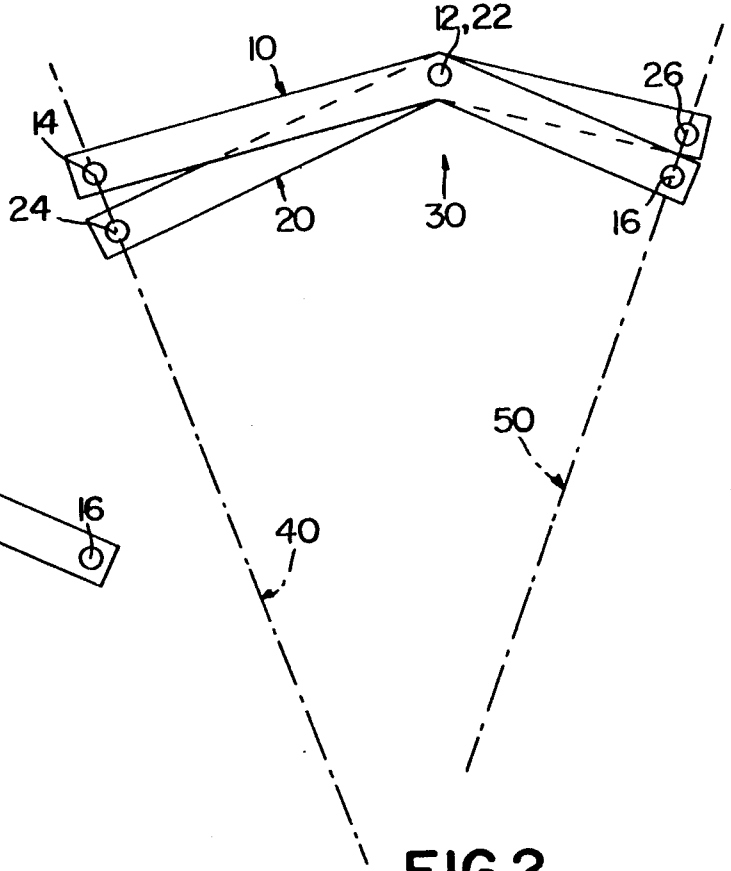
FIG. 2 is a plan view of two angulated strut elements pivotally joined intermediate to their ends, also called a scissors-pair.

In FIG. 2 the scissors pair 30 is shown. It is comprised of element 10 and an essentially identical element 20 which contains central pivot point 22 and two terminal pivot points 26 and 24. Element 10 is pivotally joined to element 20 by their respective central pivot points 12 and 22. All pivot connections described herein are simple pivot connections with one degree of freedom.

The elements 10 and 20 of scissors-pair 30 may be rotated such that pivot point 14 will lie directly over pivot point 24. Two pivot points in a scissors pair that can line up each other in this way are hereinafter referred to as paired terminal pivot points. Thus, points 14 and 24 are paired terminal pivot points. Likewise points 16 and 26 are paired terminal pivot points.

Also shown in FIG. 2 is the line 40 which is drawn through the center of paired terminal pivot points 14,24 and line 50 which is drawn through the center of paired terminal pivot points 16,26. Lines 40 and 50 form an angle between them. Lines constructed in the manner of 40 and 50 will hereinafter be referred to as normal-lines. A more precise definition of normal-lines is developed in the following paragraph.

In FIG. 2A a perspective view of the scissors pair 30 is shown. Passing through pivot point 14 is the axis 15. Similarly, axes 13,25 and 23 pass through pivot points 16,24 and 26 respectively. A normal-line 40 is constructed that intersects axes 15 and 25, and is perpendicular to both axes. A normal-line 50 is constructed that intersects axes 13 and 23, and is perpendicular to both axes. Thus the general definition of a normal-line is a line that intersects and is perpendicular to the axes of a pair of terminal pivot points.

Figure 3:
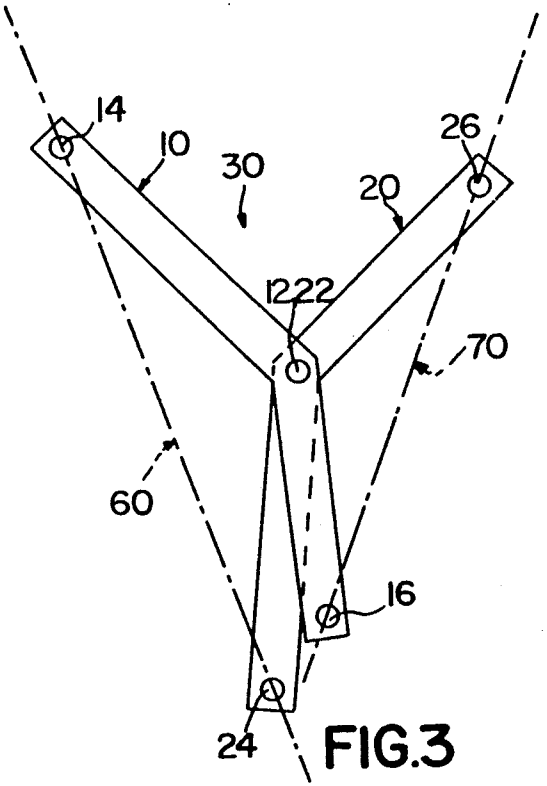
FIG. 3 is a view of the scissors pair in a different position. Also illustrated is a critical angle that remains constant for all positions of the scissors-pair.

In FIG. 3 the scissors pair 30 is shown where the elements 10 and 20 are shown rotated relative to each other. Also shown in FIG. 3 is the line 60 which is drawn through the center of paired terminal pivot points 14,24 and line 70 which is drawn through the center of paired terminal pivot points 16,26. Normal-lines 60 and 70 form an angle between them. This angle is identical to the angle between normal-lines 40 and 50. It may be mathematically demonstrated that whatever the relative rotation between elements 10 and 20, the angle between the line joining one pair of terminal pivot points with the line joining the other pair of terminal pivot points will be constant. This angle is hereinafter referred to as the normal angle. It may also be demonstrated that the normal angle is the complement of the strut-angle.

Figure 4:
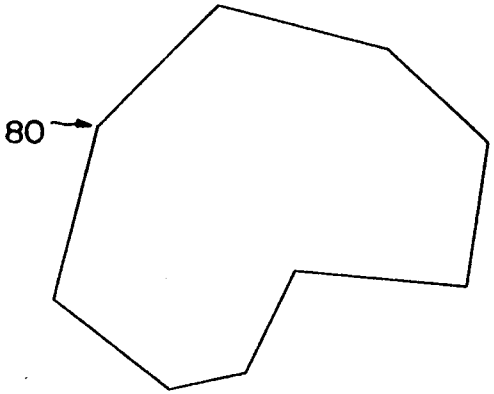
FIG. 4 is a plan view of an illustrative polygon.

FIG. 4 shows an illustrative polygon 80 where the number of sides, their relative lengths and the angles between them have been arbitrarily chosen.

Figure 5:
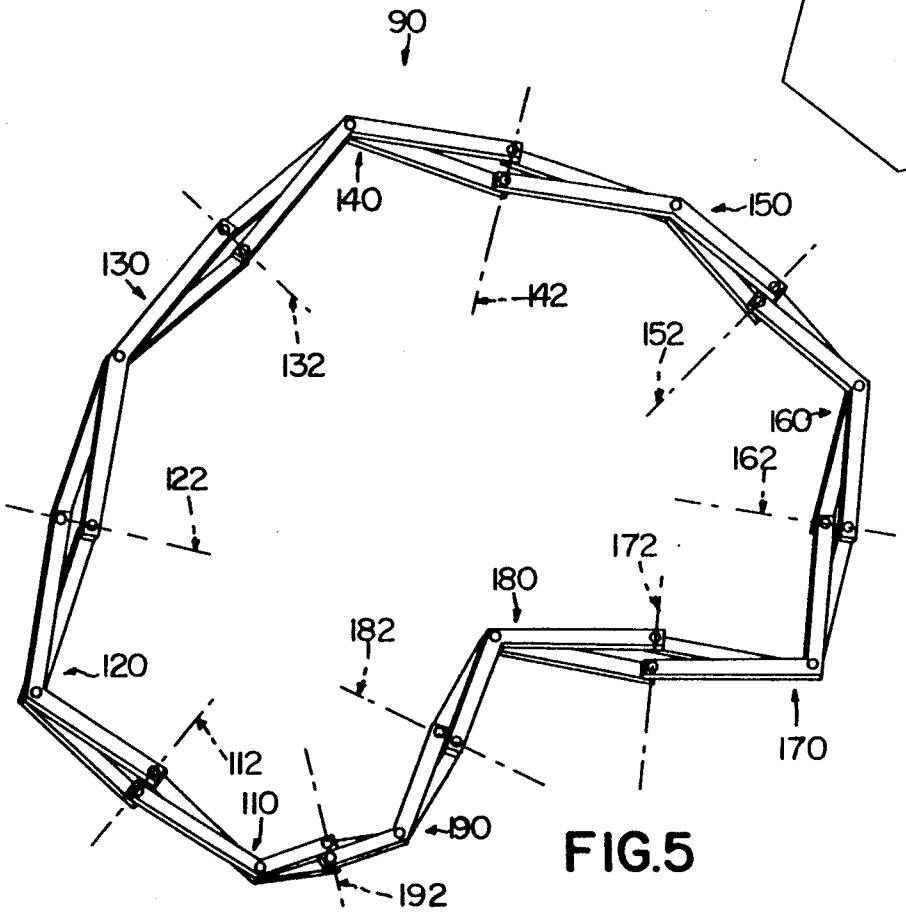
FIG. 5 is a plan view of a closed loop-assembly of scissors-pairs that approximates the polygon of FIG. 4.

In FIG. 5 is shown a closed loop-assembly 100 of nine scissors pairs 110,120,130,140,150,160,170,180,190 where each scissors-pair is pivotally joined by its two pairs of terminal pivot points to the terminal pivot points of its two adjacent scissors-pairs. This loop-assembly is an approximation of the polygon 80 in the sense that the distances between adjacent central pivot points are equal to the corresponding lengths of the sides of the polygon 80. Further, the angles between the lines joining adjacent central pivot points with other similarly formed lines in the assembly are equal to the corresponding angles in the polygon 80.

Also shown in FIG. 5 are the normal-lines 112,122,132,142,152, 162,172,182 and 192 that pass through the paired terminal pivot points of the nine scissors-pairs. Note that adjacent scissors-pairs share a normal-line.

Figure 6:
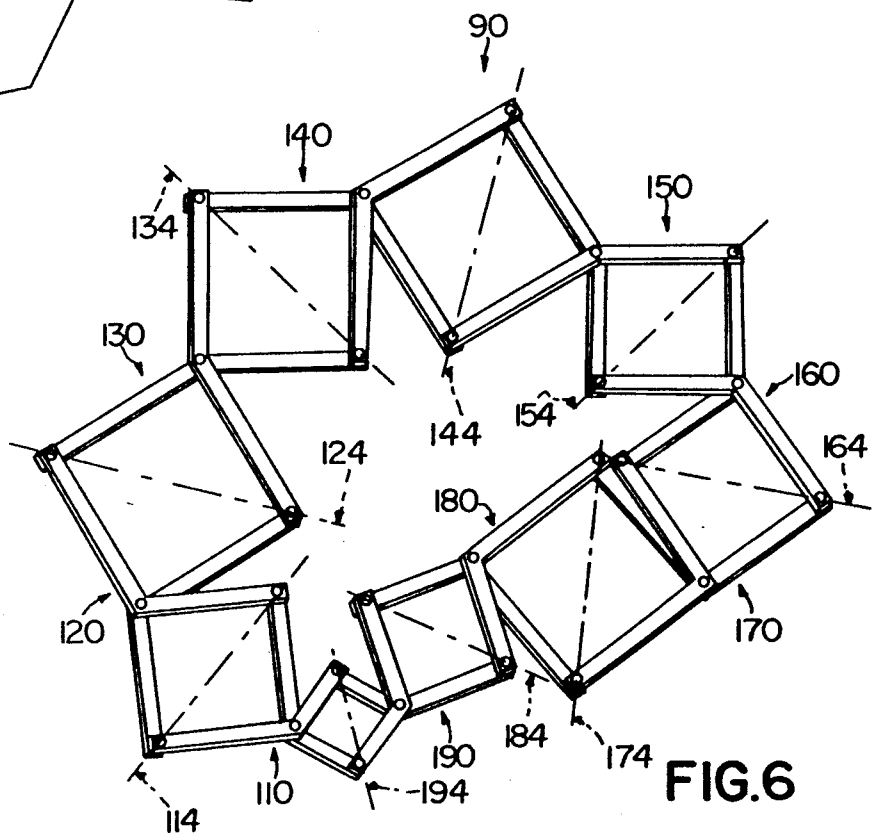
FIG. 6 is a plan view of the closed loop-assembly of FIG. 5 in a different position.

FIG. 6 shows the loop-assembly 90 folded to a different configuration without bending or distortion of any of its elements. It may be demonstrated that loop-assembly 90 is a mechanism with a degree-of-freedom equal to zero. Thus kinematics predicts such a mechanism would not be free to move. It is due to the special proportions of the links that allows it to move.

Also shown are the normal-lines 114,124,134,144,154,164, 174,184 and 194. The angle between 112 and 122 is equal to the angle between 114 and 124. Likewise the respective angle between any two lines among 112,122,132,142,152, 162,172,182 and 192 is identical to the corresponding angle between any two lines among 114,124,134, 144,154, 164,174,184 and 194.

Figure 7:
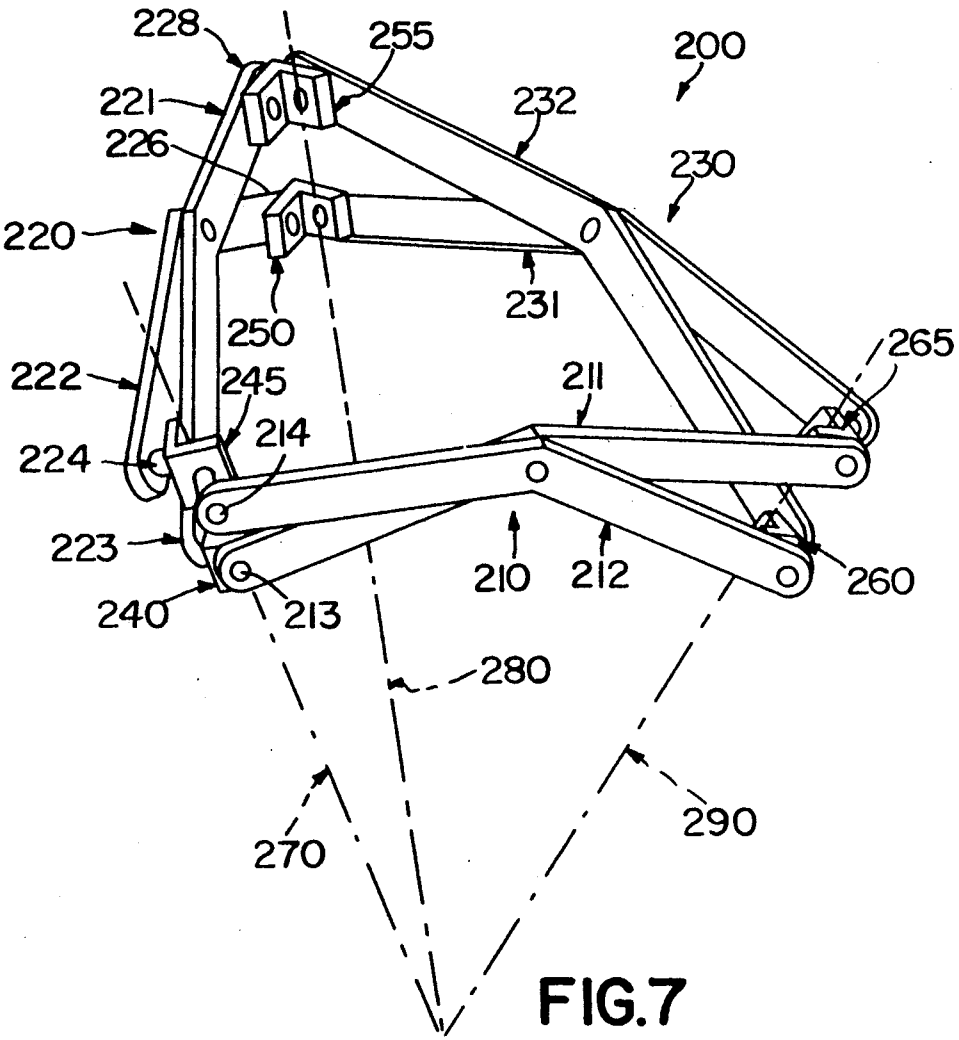
FIG. 7 is a perspective view of a different embodiment of the invention, being a three-dimensional loop-assembly comprised of three scissors-pairs and six hub elements.

FIG. 7 shows a loop-assembly 200 comprised of three angulated scissors-pairs 210,220,230 and six hub elements 240,245,250, 255,260 and 265. Scissors-pair 210 is comprised of angulated strut elements 211 and 212. Similarly, 220 is comprised of elements 221 and 222; 230 is comprised of elements 231 and 232.

Scissors-pair 210 is is pivotally joined to hub elements 240 and 245 by its paired terminal pivot points 213 and 214. Hub elements 240 and 245 are in turn pivotally joined to the paired terminal pivot points 223 and 224 of scissors-pair 220. Scissors-pair 220 is in turn pivotally joined to hub elements 250 and 255 by paired terminal pivot points 226 and 228. Said hub elements are connected to scissors-pair 230 which is similarly joined to hub elements 260 and 265. These hub elements are connected to scissors-pair 210, thereby closing the loop.

Also shown in FIG. 7 are three normal-lines 270,280 and 290. Line 270 intersects and is perpendicular to the axes that pass through paired terminal pivot points 213 and 214. Likewise, line 270 intersects and is perpendicular to the axes that pass through paired terminal pivot points 223 and 224. In this manner, normal-line 270 is shared by the scissors-pairs 210 and 220. Similarly, normal-line 280 is shared by the scissors-pairs 220 and 230, and normal-line 290 is shared by the scissors-pairs 230 and 210.

Figure 8:
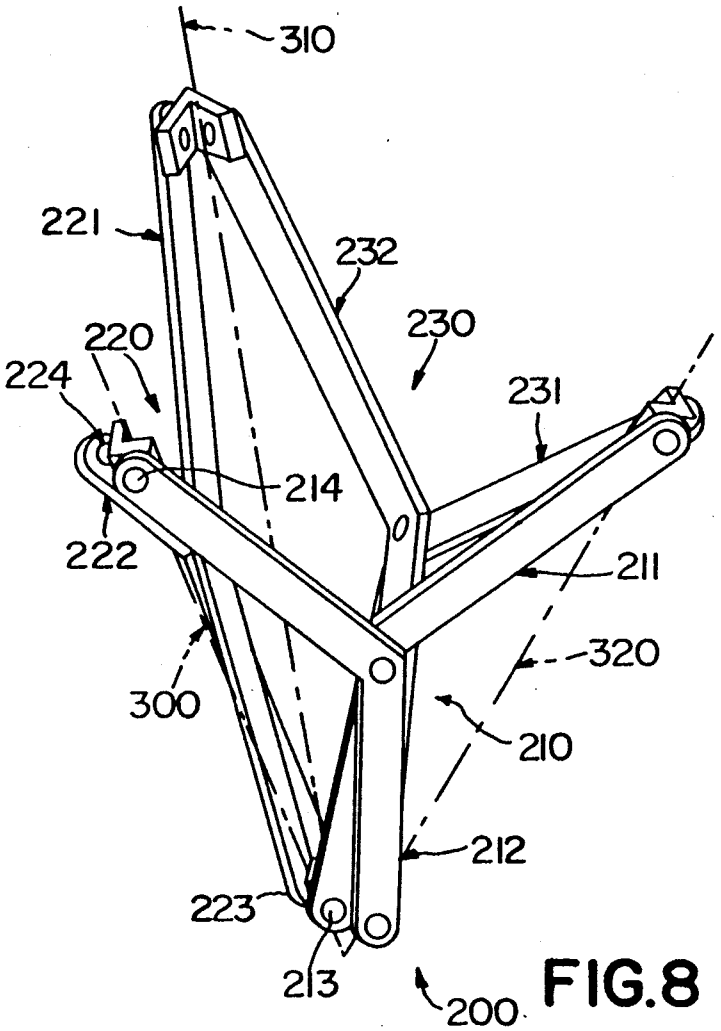
FIG. 8 is a perspective view of the loop-assembly of FIG. 7 in a different position.

FIG. 8 shows the loop-assembly 200 folded to a different configuration. The angulated strut-elements 211 and 212 have been rotated relative to each other. Similarly rotated are the elements 221 and 222 as well as 231 and 232. This changed configuration of assembly 200 is accomplished without bending or distortion of any of its elements. Also shown are three normal-lines 300,310 and 320. Normal-line 300 is shared by the scissors-pairs 210 and 220 in the manner described above. In the same manner, normal-line 310 is shared by scissors-pair 220 and 230 and normal-line 320 is shared by scissors-pair 230 and 210.

The angle between normal-lines 300 and 310 is identical to the angle between lines 270 and 280. Similarly, the angle between normal-lines 310 and 320 is identical to the angle between lines 280 and 290. Also, the angle between normal-lines 320 and 300 is identical to the angle between lines 290 and 270. When the relative rotation between two strut elements of any scissors-pair in the loop-assembly is changed, all angles between the normal-lines in the loop-assembly remain constant.

Figure 9:
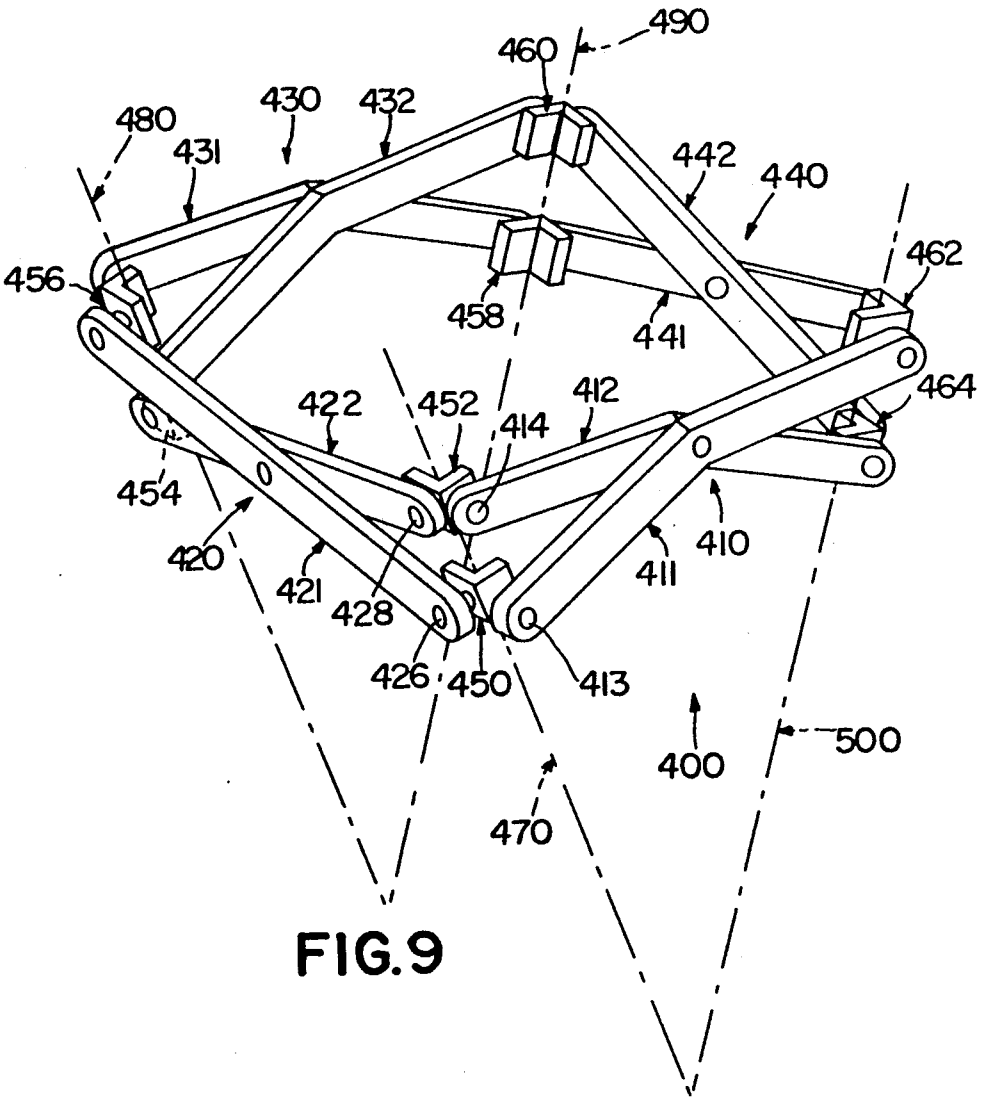

In FIG. 9 is shown loop-assembly 400 which is comprised of two angulated scissors-pairs 410 and 430, two straight scissors-pairs 420 and 440, as well as eight hub elements 450,452,454,456,458,460,462 and 464. Also shown are normal-lines 470,480,490 and 500. Scissors-pair 410 is pivotally joined to hub elements 450 and 452 by paired terminal pivot points 413 and 414. Said hub elements are in turn pivotally joined to paired terminal pivot points 426 and 428 belonging to scissors-pair 420. Similarly, 420 is connected to 430 by elements 454 and 456; 430 is connected to 440 by elements 458 and 460; 440 is connected to 410 by elements 462 and 464, thus closing the loop.

Also shown in FIG. 9 is normal line 470 which intersects and is perpendicular to the axes passing through paired terminal pivot points 413 and 414 as well as terminal pivot points 426 and 428. Thus, normal-line 470 is shared by scissors-pairs 410 and 420. Similarly normal-line 480 is shared by scissors-pairs 420 and 430, normal-line 490 is shared by scissors-pairs 430 and 440 and normal-line 500 is shared by scissors-pairs 440 and 410.

Figure 10:
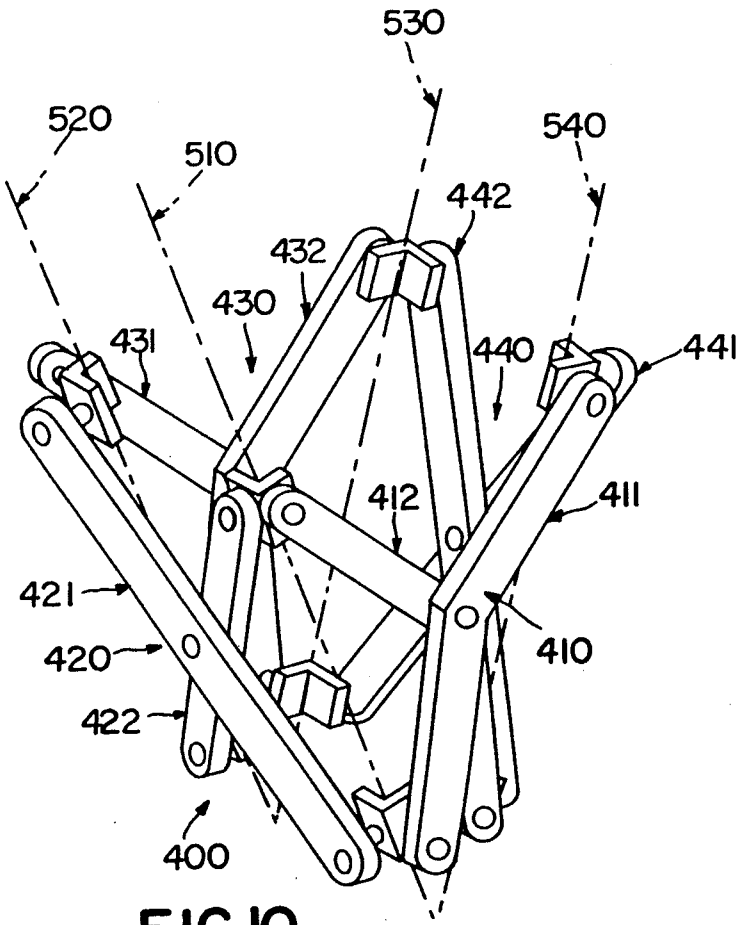
FIGS. 9–10 are perspective views of a different embodiment of the invention in two positions.

FIG. 10 shows the loop-assembly 400 folded to a different configuration. The strut-elements 411 and 412 have been rotated relative to each other. Similarly rotated are the elements 421 and 422, 431 and 432, as well as 441 and 442. This changed configuration of assembly 400 is accomplished without bending or distortion of any of its elements. Also shown are four normal-lines 510,520,530 and 540. Normal-line 510 is shared by the scissors-pairs 410 and 420, in the sense that has been described above. Similarly, normal-line 520 is shared by the scissors-pairs 420 and 430, normal-line 530 is shared by the scissors-pairs 430 and 440, and normal-line 540 is shared by the scissors-pairs 440 and 410.

The angle between normal-lines 510 and 520 is identical to the angle between lines 470 and 480. Similarly, the angle between normal-lines 520 and 530 is identical to the angle between lines 480 and 490; the angle between normal-lines 530 and 540 is identical to the angle between lines 490 and 500; the angle between normal-lines 540 and 510 is identical to the angle between lines 500 and 470. As above, when the relative rotation between two strut elements of any scissors-pair in the loop-assembly is changed, all angles between the normal-lines in the loop-assembly remain constant.

Figure 11:
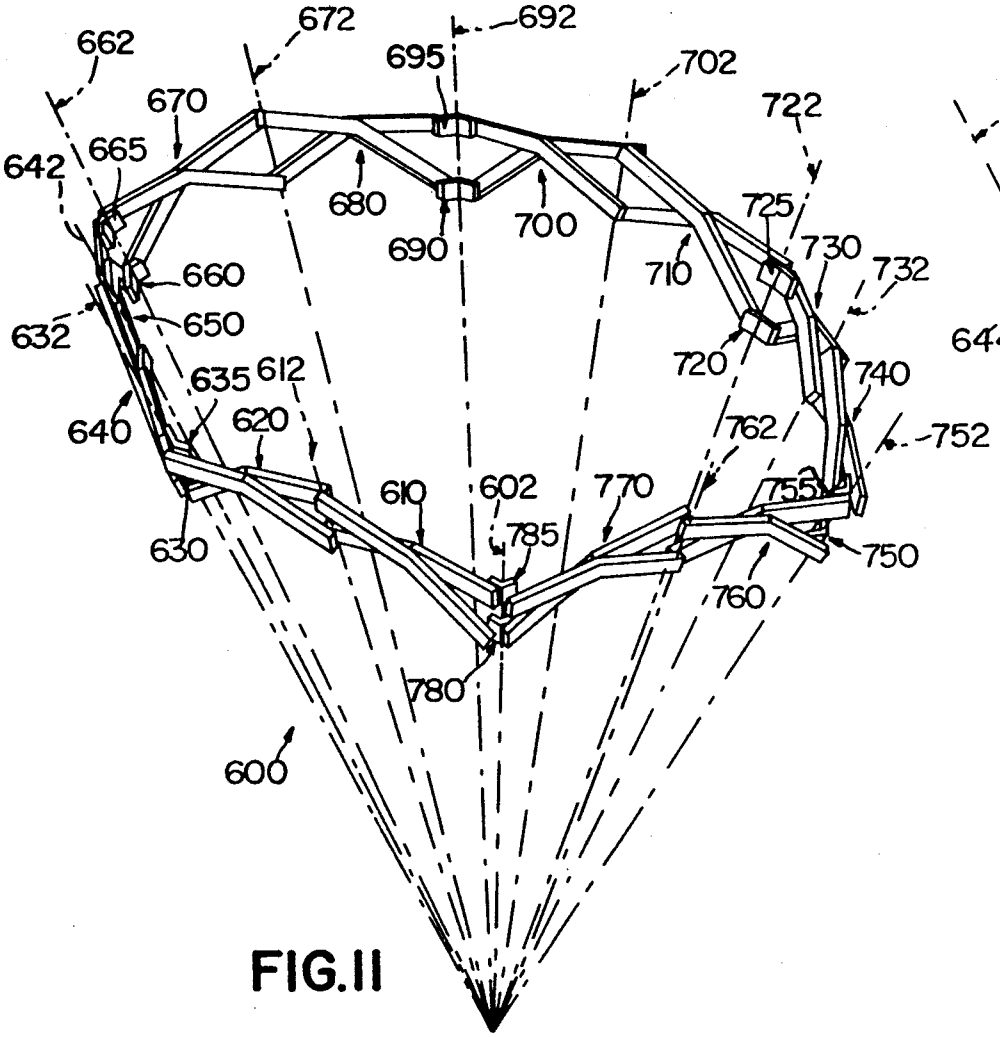

In FIG. 11 is shown the loop-assembly 600 which is comprised by 12 scissors-pairs and 12 hub elements. The loop is connected as follows: scissors-pair 610 joined to scissors-pair 620, by joining the paired terminal pivot points of one directly to the paired terminal pivot points to the other. Connections of this type are hereinafter referred to as a type 1 connection.

Scissors-pair 620 is pivotally joined to hub elements 630 and 635 by its remaining paired terminal pivot points. 630 and 635 are pivotally joined to a pair of terminal pivot points belonging to scissors-pair 640. Thus, scissors-pair 620 is joined to 640 via hub elements 630 and 635 by what is hereinafter referred to as a type 2 connection.

Scissors-pair 640 has a type 1 connection to 650; 650 has a type 2 connection to 670 via elements 660 and 665; 670 has a type 1 connection to 680; 680 has a type 2 connection to 700 via elements 690 and 695; 700 has type 1 connection to 710; 710 has a type 2 connection to 730 via elements 720 and 725; 730 has a type 1 connection to 740; 740 has a type 2 connection to 760 via elements 750 and 755; 760 has a type 1 connection to 770; 770 has a type 2 connection to 610 via elements 780 and 785. This last connection closes the loop.

Also shown in FIG. 11 are twelve normal-lines 602,612,632,642, 662,672,692,702,722,732,752,762 that intersect and are perpendicular to the axes of the joined terminal pivot points of adjacent scissors-pairs.

Figure 12:
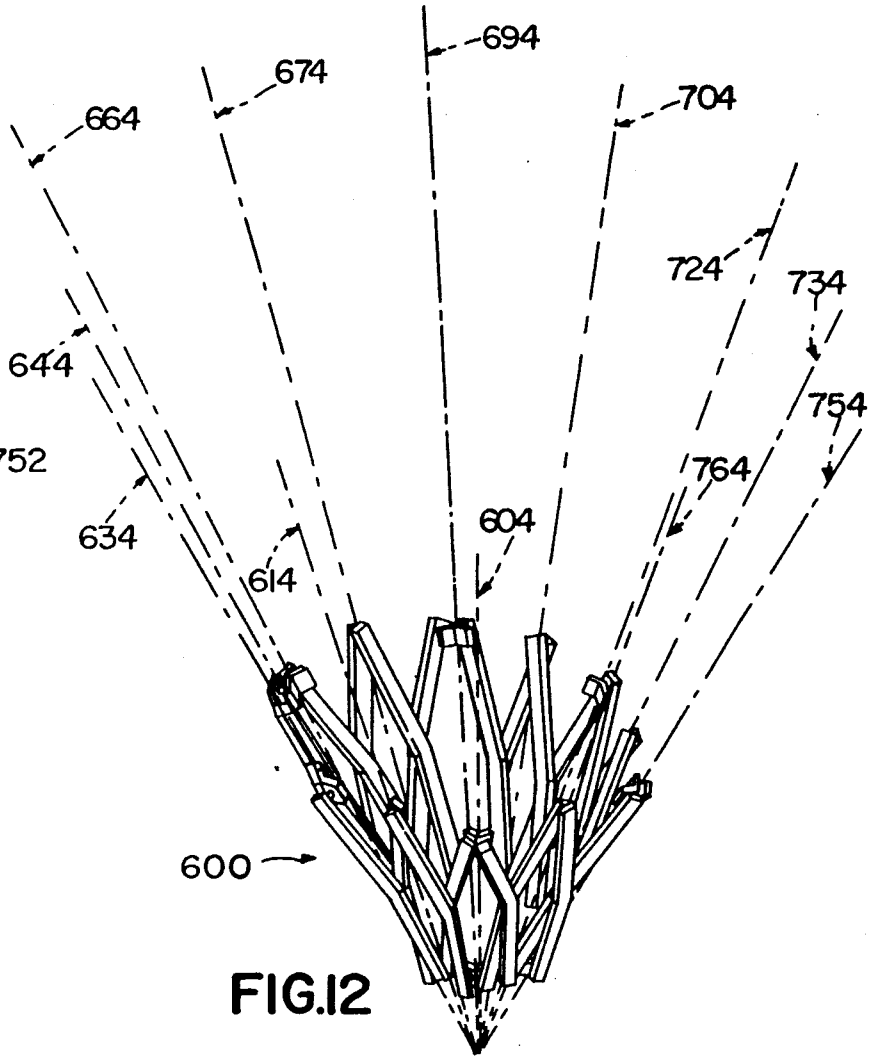
FIGS. 11–12 are perspective views of a different embodiment of the invention in two positions.

In FIG. 12 the loop-assembly 600 is shown folded to a different configuration where each of the two strut elements belonging to every scissors pair have been rotated relative to each other. As above, this folding takes place without bending or distortion of any of the elements in the assembly. Also shown in FIG. 12 are twelve normal-lines 604,614,634, 644, 664,674,694,704,724,734,754 and 764 that intersect and are perpendicular to the axes of the joined associated pivot points of adjacent scissors-pairs.

The angle between 602 and 612 is identical to the angle between 604 and 614. As above, when the relative rotation between two strut elements of any scissors-pair in the loop-assembly is changed, all angles between the normal-lines in the loop-assembly remain constant.

Figure 16:
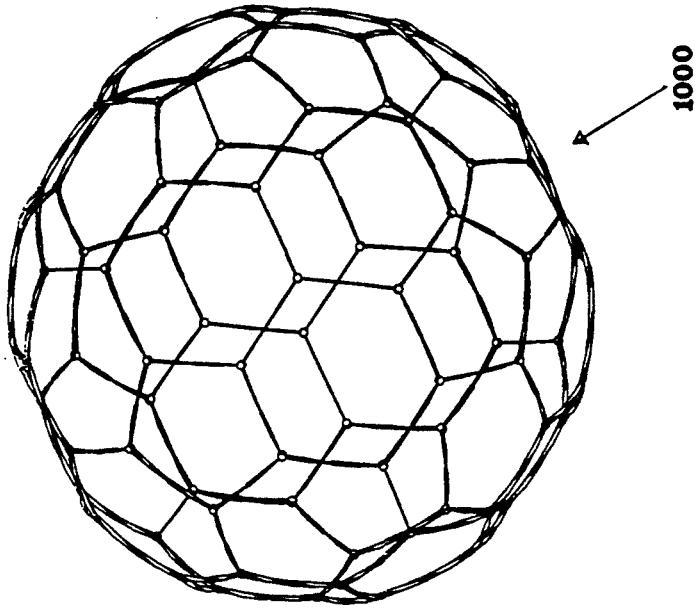
FIGS. 13–16 show a sequence of perspective views of a complete spherical structure which is comprised of loop-assemblies, as it expands.
Figure 15:
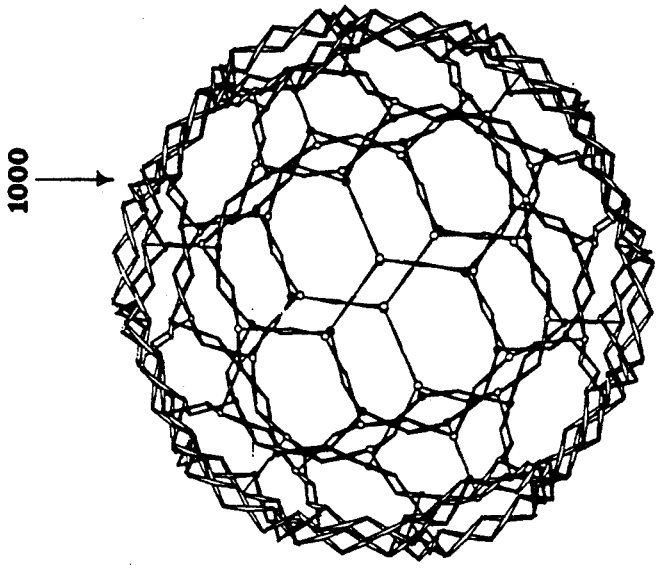
Figure 14:
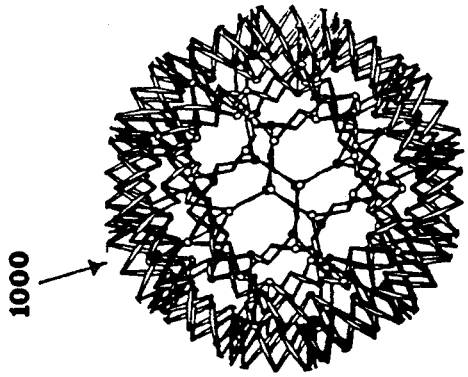
Figure 13:
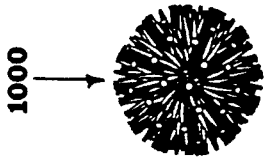

In FIG. 13 a spherical truss structure 1000, which is comprised of a multiplicity of loop-assemblies as described above, is shown in an entirely folded (collapsed) configuration. FIG. 14 and FIG. 15 each show partially folded configurations of the structure 1000. FIG. 16 shows the structure 1000 in an entirely unfolded (open) configuration. The folding of the structure 1000 takes place without bending or distortion of any of its elements. As the structure is folded and unfolded, all angles between the normal-lines in the structure remain constant.

In FIG. 16 the centers of the central pivot points of all the scissors-pairs in the unfolded structure 1000 lie on a common surface, in this case a sphere. In FIG. 13 the centers of the central pivot points of all the scissors-pairs in the structure lie on a common surface that is also spherical, but of a smaller scale than the surface of FIG. 16. Likewise, in FIGS. 14–15 which show partially folded configurations of the structure 1000, the centers of the central pivot points of all the scissors-pairs in the structure lie on a common spherical surface for each configuration. For any configuration of the structure, the centers of the central pivot points of all scissors-pairs will lie on a spherical surface. As the structure is folded and unfolded, only the scale of this surface changes, not its three-dimensional shape.

Figure 20:
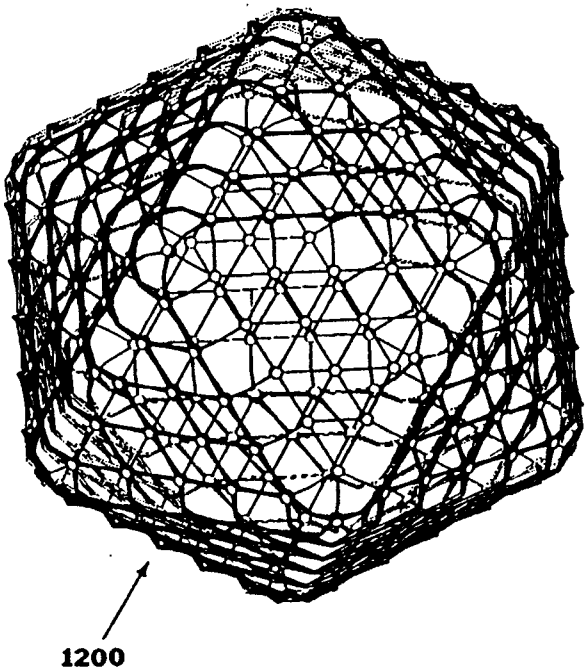
FIGS. 17–20 show a sequence of perspective views of a complete faceted icosahedral structure which is comprised of loop-assemblies, as it expands.
Figure 19:
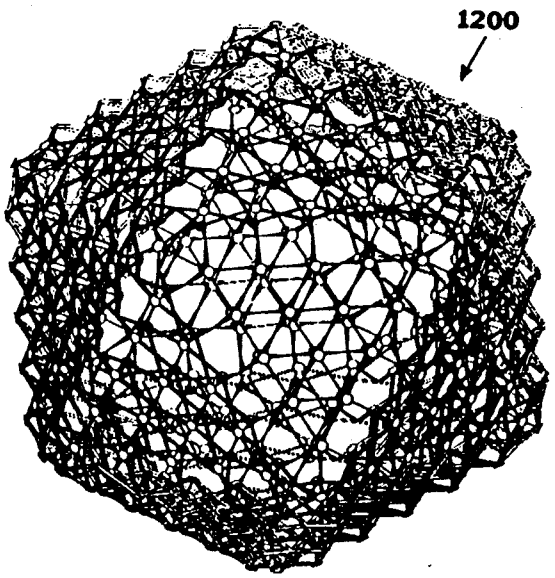
Figure 18:
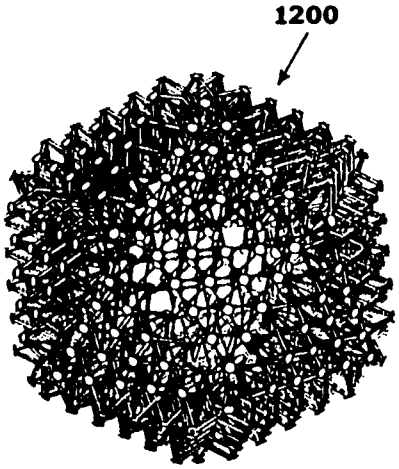
Figure 17:
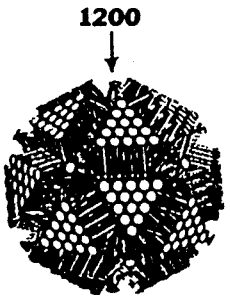

In FIG. 17 a truss structure 1200, of icosahedral geometry, which is comprised of a multiplicity of loop-assemblies as described above, is shown in an entirely folded (collapsed) configuration. FIG. 18 and FIG. 19 each show partially folded configurations of the structure 1200. FIG. 20 shows the structure 1200 in an entirely unfolded (open) configuration. The folding takes place without bending or distortion of any of its elements. As the structure is folded and unfolded, all angles between the normal-lines in the structure remain constant.

In FIG. 20 the centers of the central pivot points of all the scissors-pairs in the unfolded structure 1200 lie on a common surface, in this case an icosahedron. In FIG. 17 the centers of the central pivot points of all the scissors-pairs in the structure lie on a common surface that is also icosahedral but of a smaller scale than that surface of FIG. 20. Likewise, in FIGS. 18–19 which show partially folded configurations of the structure 1200, the centers of the central pivot points of all the scissors-pairs in the structure lie on common icosahedral surfaces. As the structure is folded and unfolded, only the scale of this icosahedral surface changes, not its three-dimensional shape.

Figure 21:
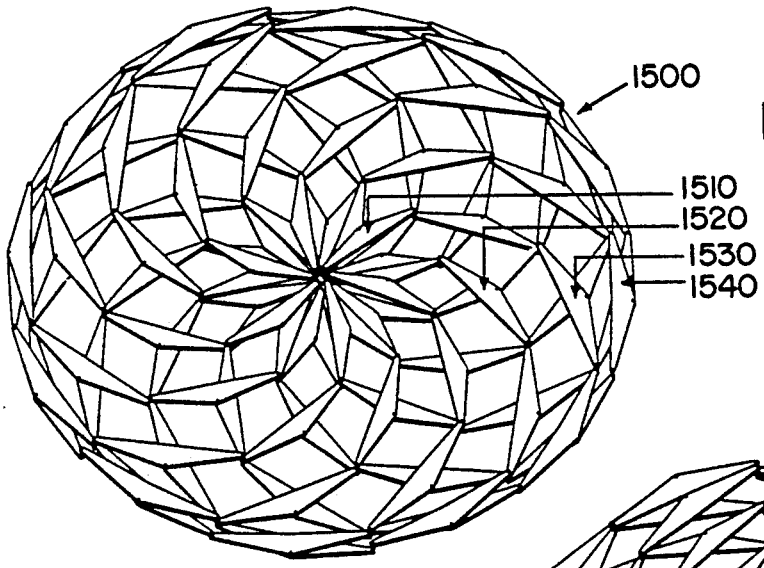
FIGS. 21–23 show a sequence of views of an alternate embodiment of the invention which is a planar retractable structure with an iris-type motion.

In FIG. 21 a planar structure 1500 is shown which is an alternate embodiment of the invention. It is comprised of four loop-assemblies, 1510, 1520, 1530 and 1540. The inner terminal pivot points of 1510 meet at the center of the structure. The outer terminal pivot points of loop-assembly 1510 are pivotally joined to the inner terminal pivot points of loop-assembly 1520. Similarly the outer terminal pivot points of 1520 are joined to the inner terminal pivot points of 1530. The outer terminal pivot points of loop-assembly 1530 are in turn joined to the inner terminal pivot points of 1540.

Figure 22:
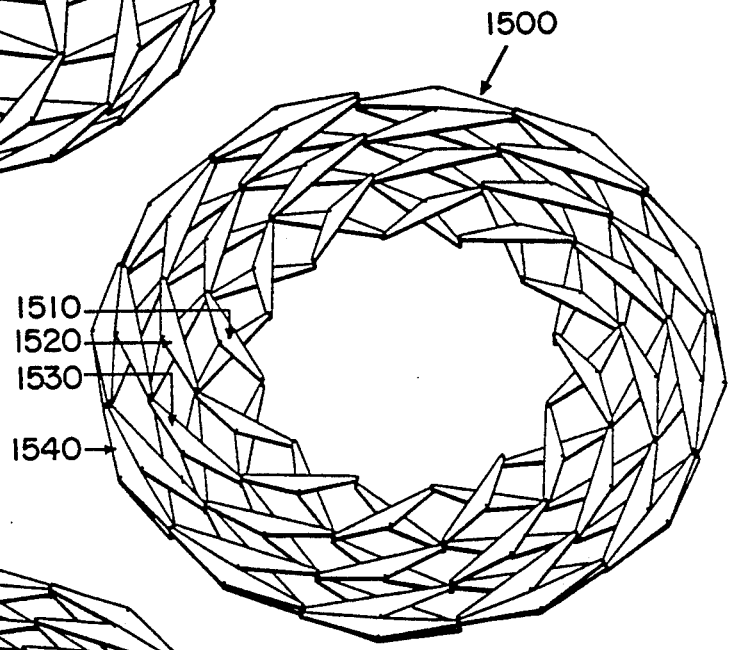

In FIG. 22, the structure 1500 is shown in a partially retracted position, where the structs of all scissors pairs have undergone a relative rotation. The inner terminal pivot points of loop-assembly 1510 have moved outwards from their position in FIG. 21. The terminal pivot points of the loop-assembly 1540 have moved relatively little from their position in FIG. 21. Thus the size of the outer perimeter of the structure 1500 has changed very little between the positions shown in FIGS. 21 and 22.

Figure 23:
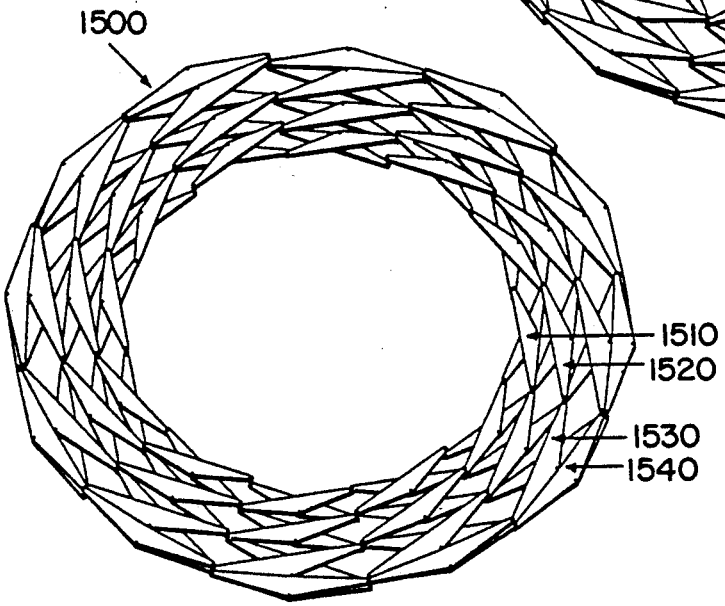

In FIG. 23 the structure 1500 is shown in a retracted position. The inner terminal pivot points of loop assembly 1510, lie in and define the inner perimeter of the structure. This inner perimeter has changed substantially from the positions shown in FIGS. 22 and 21. However the outer perimeter of the structure 1500, which the outer terminal pivot points of loop-assembly 1540 lie in, has changed very little from the earlier positions. The essential motion of the structure 1500 is that of the inner portion of the structure moving outwards towards the perimeter. In this sense it may be described as an iris-type retractable structure.

In FIG. 24 the retractable structure 2000 is shown, which is comprised of six loop assemblies 2010,2020,2030,2040,2050 and 2060. The inner hub elements of loop assembly 2010 meet near the center of the structure. The outer hub elements of loop-assembly 2010 are joined to the inner hub elements of loop-assembly 2020. Similarly, the outer hub elements of loop-assembly 2010 are joined to the inner hub elements of loop-assembly 2020. In the same manner, loop-assemblies 2030,2040 and 2050 are joined to 2040,2050 and 2060 respectively.

In FIG. 25 the structure 2000 is shown in a partially retracted position. The inner perimeter of the structure, which the inner terminal pivot points of loop-assembly 2010 lie in and define, has moved outwards from the center. The outer perimeter of the structure, which the outer terminal pivot points of loop-assembly 2060 lie in, has moved very little from its position in FIG. 24.

The structure 2000 is shown in a further retracted position in FIG. 26. The loop-assemblies that make up the structure have moved further outwards towards the perimeter.

In FIG. 27 the structure 2000 is shown in its fully retracted position. This inner perimeter has changed substantially from the positions shown in FIGS. 24–26. However the outer perimeter of the structure 2000, which the outer terminal pivot points of loop-assembly 2060 lie in, has changed very little from the earlier positions. Thus the structure has maintained a nearly constant diameter during the unfolding process.

Figure 28:
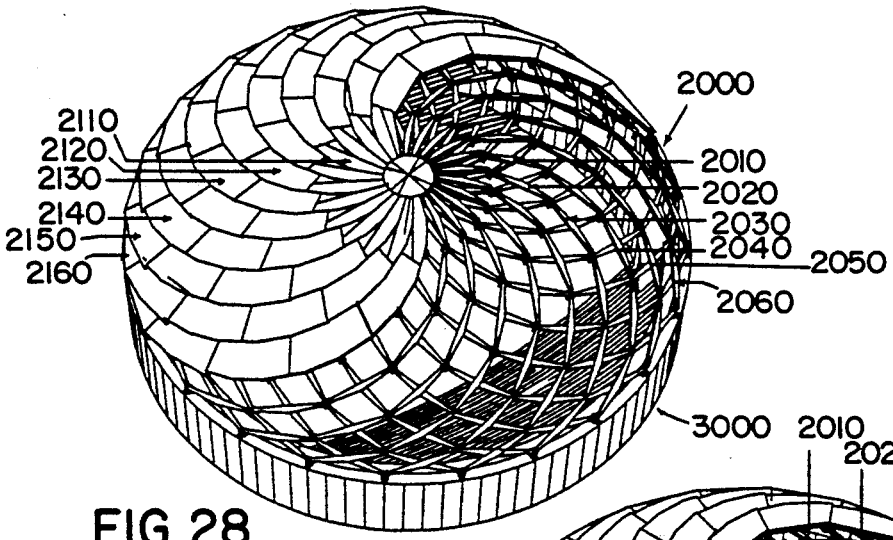
FIGS. 28–30 show a sequence of views of the structure illustrated in FIGS. 24–27 with a covering attached to it, to be used as a retractable roof.

FIG. 28 shows the structure 2000 used as a retractable roof over a stadium 3000. A covering is provided to give shelter (only half the roof is shown covered to make the illustration clear). A series of plates 2110 have been attached to individual elements of the loop-assembly 2010. Similarly a series of plates 2120 have been attached to loop-assembly 2020. In this manner plate series 2130,2140,2150 and 2160 are attached to loop-assemblies 2030,2040,2050 and 2060 respectively. The plates overlap each other in a shingled pattern to ensure protection from the elements.

Figure 29:
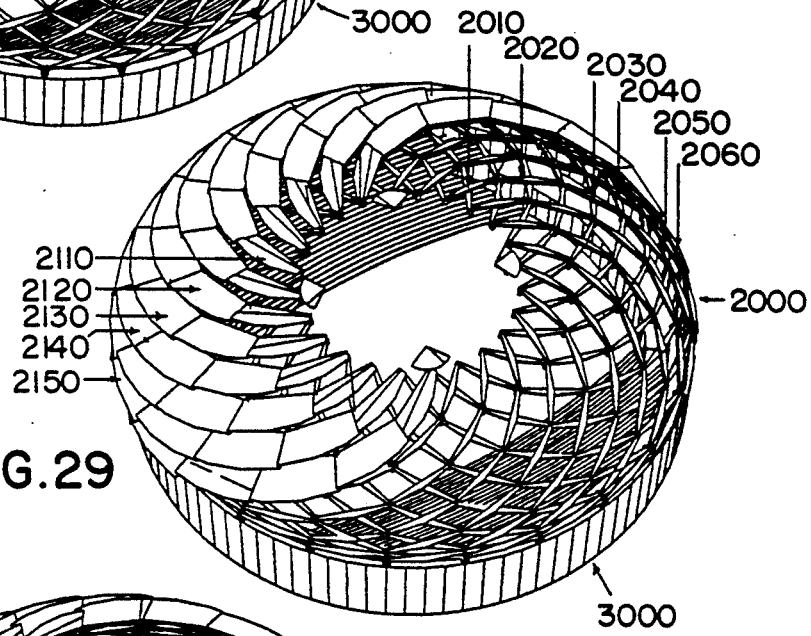

In FIG. 29 the structure 2000 is shown in a partially retracted position, the inner perimeter of the structure having moved outwards towards the circumference. The plates 2110 move outwards with the loop-assembly 2010 to which they are attached. They glide over adjacent plates without interfering with each other. Similarly plate series 2120,2130,2140,2150 and 2160 move outwards, attached to their respective loop-assemblies, without interfering with each other.

Figure 30:
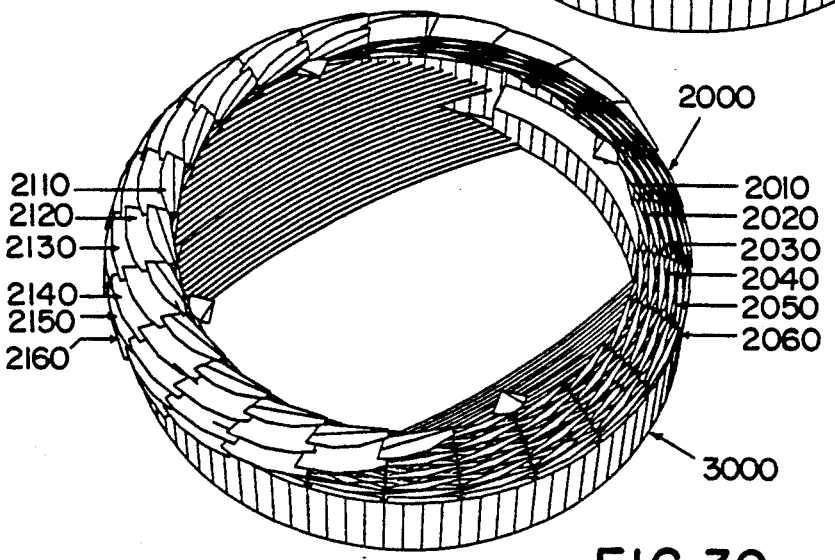

FIG. 30 shows the structure 2000 in its fully retracted position. The plate series 2110,2120,2130,2140,2150 and 2160 are located in a compact configuration around the edge of the structure, still attached to their respective loop-assemblies. Again there is no interference between the plate series.

Figure 31:
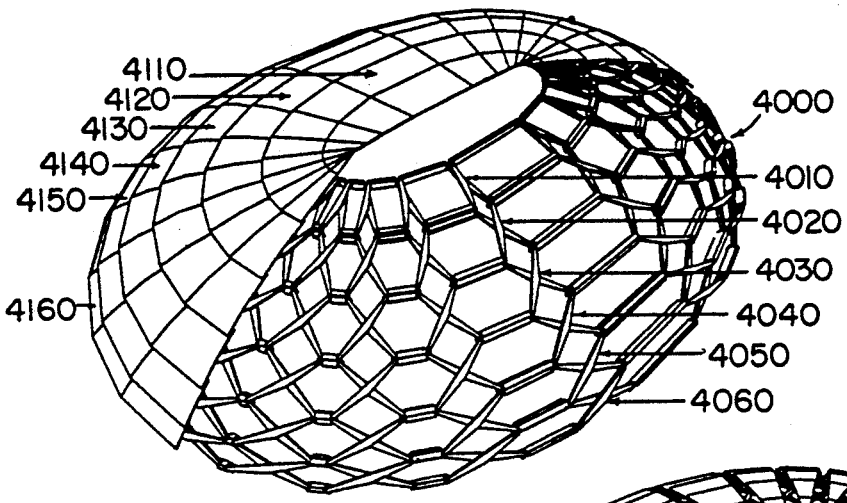
FIGS. 31–33 show a sequence of views of an iris-type retractable structure having an oval-shaped perimeter and a covering attached to it.

In FIG. 31 the retractable structure 4000 is shown, which is comprised of six loop assemblies 4010,4020,4030,4040,4050 and 4060. In this embodiment of the invention, the hub elements are of varying length to provide an oval-shaped perimeter to the structure. The inner hub elements of loop assembly 4010 meet near the center of the structure. The outer hub elements of loop-assembly 4010 are joined to the inner hub elements of loop-assembly 4020. In this manner, the outer hub elements of loop-assemblies 4020,4030,4040 and 4050 are joined to the inner hub elements of 4030,4040,4050 and 4060 respectively.

Also shown in FIG. 31 is a covering over the structure 4000, to provide shelter (only half the roof is shown covered to make the illustration clear). A series of plates 4110 have been attached to individual elements of the loop-assembly 4010 in an alternate arrangement to the covered structure shown in FIG. 28. Similarly a series of plates 4120 have been attached to loop-assembly 4020. In this manner plate series 4130,4140,4150 and 4160 are attached to loop-assemblies 4030,4040,4050 and 4060 respectively. The plates overlap each other in a shingled pattern to ensure protection from the elements.

Figure 32:
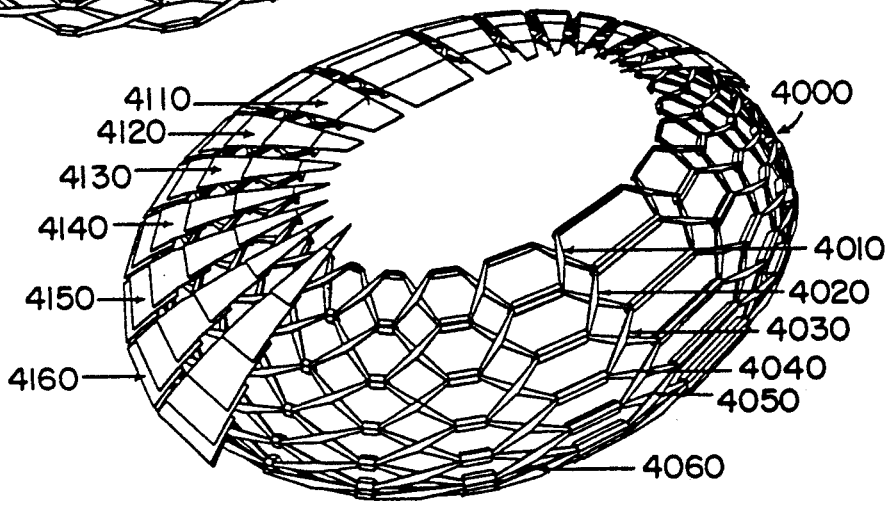

In FIG. 32 the structure 4000 is shown in a partially retracted position. The inner perimeter of the structure, which the inner terminal pivot points of loop-assembly 4010 lie in and define, has moved outwards from the center. The plates 4110 move outwards with the loop-assembly 4010 to which they are attached. They glide over adjacent plates without interfering with each other. Similarly plate series 4120,4130,4140,4150 and 4160 move outwards, each attached to their respective loop-assemblies, without interfering with each other. The outer perimeter of the structure, which the outer terminal pivot points of loop-assembly 4060 lie in, has moved very little from its position in FIG. 31.

Figure 33:
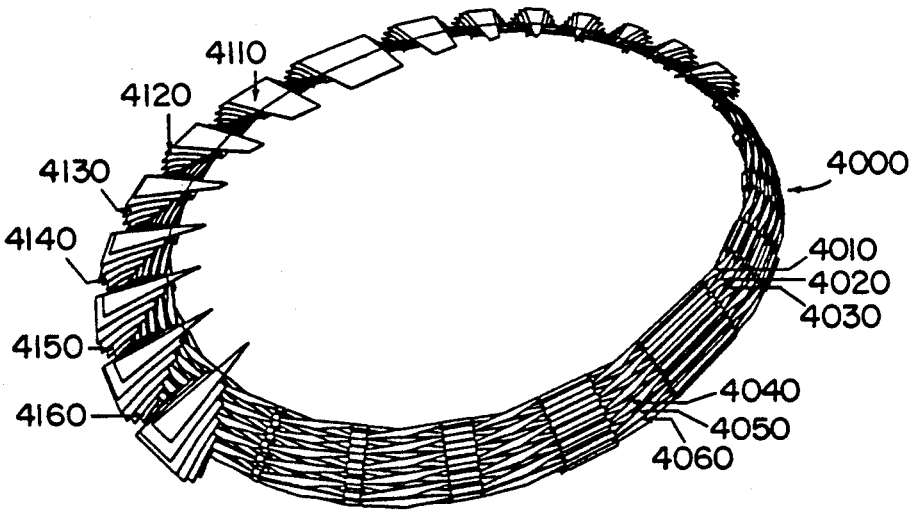

In FIG. 33 the structure 4000 is shown in its fully retracted position. This inner perimeter has changed substantially from the positions shown in FIGS. 31–32. However the outer perimeter of the structure 4000, which the outer terminal pivot points of loop-assembly 4060 lie in, has changed very little from the earlier positions. Thus the structure has maintained a nearly constant perimeter during the retracting process. The plate series 4110,4120,4130,4140,4150 and 4160 are located in a compact configuration around the edge of the structure, still attached to their respective loop-assemblies. Again there is no interference between the plate series.

It will be appreciated that the instant specification and claims are set forth by way of illustration and not limitation, and that various modifications and changes may be made without departing from the spirit and scope of the present invention.

What is claimed is:

1. A loop-assembly comprising:

at least three scissors-pairs, at least two of the pairs comprising:

two essentially identical rigid angulated strut elements, each having a central and two terminal pivot points which do not lie in a straight line, each strut being pivotally joined to the other of its pair by their central pivot points, each pair being pivotally joined by two terminal pivot points to two terminal pivot points of another pair such that both scissors pairs lie essentially in the same plane, whereby a closed loop-assembly is thus formed of scissors pairs, and this loop-assembly can fold and unfold, and a line that intersects and is perpendicular to the axes of any two terminal pivot points is non-parallel with at least two other similarly formed lines in the assembly, the angles formed between said lines remaining constant as the loop assembly is folded and unfolded.

2. A reversibly expandable three dimensional truss structure that is in at least part comprised of a loop-assembly according to claim 1, the angles formed between normal lines that intersect and are perpendicular to the axes of terminal pivot points with other similarly formed lines throughout the structure, remaining constant as it is folded and unfolded.

3. A reversibly expandable three dimensional truss structure that is in at least part comprised of a loop-assembly according to claim 1, the central pivot points of all the scissors-pairs in the structure lying on a common first surface when the structure is in a folded condition, these same points lying on and defining a second surface that is identical except in scale, to the first surface when the structure is in an unfolded or partially folded condition.

4. A reversibly expandable three dimensional truss structure that is in at least part comprised of a loop-assembly according to claim 1, wherein the three dimensional shape of the structure is unchanged as it is folded and unfolded.

5. A reversible retractable truss structure that is in at least part comprised of a loop-assembly according to claim 1, where the outer terminal pivot points of at least one loop-assembly are pivotally joined to the inner terminal pivot points of another loop assembly.

6. A reversibly retractable truss structure that is in at least part comprised of a loop-assembly according to claim 1, where the outer hub elements of at least one loop-assembly are joined to the inner hub elements of another loop assembly.

7. A reversibly retractable truss structure that is in at least part comprised of a loop-assembly according to claim 1, where the size of the inner perimeter of the structure changes substantially as the structure is folded and unfolded, but the size of the outer perimeter changes relatively little.

8. A reversibly retractable truss structure according to claim 7, where a covering is provided by attaching plates to the elements of the loop-assemblies that comprise the structure.

9. A loop-assembly comprising:

at least three scissors-pairs, at least two of the pairs comprising:

two essentially identical rigid angulated strut elements, each having a central and two terminal pivot points which do not lie in a straight line, each strut being pivotally joined to the other of its pair by their central pivot points, each pair being pivotally joined by two terminal pivot points to two terminal pivot points of another pair in that, the terminal points of a scissors-pair are each pivotally joined to a hub element, and these hub elements are in turn joined to the terminal pivot points of another scissors-pair, whereby a closed loop-assembly is thus formed of scissors pairs, and this loop-assembly can fold and unfold, and a line that intersects and is perpendicular to the axes of any two terminal pivot points is non-parallel with at least two other similarly formed lines in the assembly, the angles formed between said lines remaining constant as the loop assembly is folded and unfolded.

10. A reversibly expandable three dimensional truss structure that is in at least part comprised of a loop-assembly according to claim 9, the angles formed between normal lines that intersect and are perpendicular to the axes of terminal pivot points with other similarly formed lines throughout the structure, remaining constant as it is folded and unfolded.

11. A reversibly expandable three dimensional truss structure that is in at least part comprised of a loop-assembly according to claim 9, the central pivot points of all the scissors-pairs in the structure lying on a common first surface when the structure is in a folded condition, these same points lying on and defining a second surface that is identical except in scale, to the first surface when the structure is in an unfolded or partially folded condition.

12. A reversibly expandable three dimensional truss structure that is in at least part comprised of a loop-assembly according to claim 9, wherein the three dimensional shape of the structure is unchanged as it is folded and unfolded.

13. A reversibly retractable truss structure that is in at least part comprised of a loop-assembly according to claim 9, where the outer terminal pivot points of at least one loop-assembly are pivotally joined to the inner terminal pivot points of another loop assembly.

14. A reversibly retractable truss structure that is in at least part comprised of a loop-assembly according to claim 9, where the outer hub elements of at least one loop-assembly are joined to the inner hub elements of another loop assembly.

15. A reversibly retractable truss structure that is in at least part comprised of a loop-assembly according to claim 9, where the size of the inner perimeter of the structure changes substantially as the structure is folded and unfolded, but the size of the outer perimeter changes relatively little.

16. A reversibly retractable truss structure according to claim 15, where a covering is provided by attaching plates to the elements of the loop-assemblies that comprise the structure.

17. A loop-assembly according to claim 9, further including at least two scissors pairs each comprising:

two essentially identical rigid angulated strut elements, each having a central and two terminal pivot points which do not lie in a straight line, each strut being pivotally joined to the other of its pair by their central pivot points, each pair being pivotally joined by two terminal pivot points to two terminal pivot points of another pair in that, the terminal pivot points of each of the scissors pairs are pivotally joined to the terminal pivot points of the adjacent pair such that both scissors pairs lie essentially in the same plane.

18. A reversibly expandable three dimensional truss structure that is in at least part comprised of a loop-assembly according to claim 17, the angles formed between normal lines that intersect and are perpendicular to the axes of terminal pivot points with other similarly formed lines throughout the structure, remaining constant as it is folded and unfolded.

19. A reversibly expandable three dimensional truss structure that is in at least part comprised of a loop-assembly according to claim 17, the central pivot points of all the scissors-pairs in the structure lying on a common first surface when the structure is in a folded condition, these same points lying on and defining a second surface that is identical except in scale, to the first surface when the structure is in an unfolded or partially folded condition.

20. A reversibly expandable three dimensional truss structure that is in at least part comprised of a loop-assembly according to claim 17, wherein the three dimensional shape of the structure is unchanged as it is folded and unfolded.

21. A reversibly retractable truss structure that is in at least part comprised of a loop-assembly according to claim 17, where the outer terminal pivot points of at least one loop-assembly are pivotally joined to the inner terminal pivot points of another loop assembly.

22. A reversibly retractable truss structure that is in at least part comprised of a loop-assembly according to claim 17, where the outer hub elements of at least one loop-assembly are joined to the inner hub elements of another loop assembly.

23. A reversibly retractable truss structure that is in at least part comprised of a loop-assembly according to claim 17, where the size of the inner perimeter of the structure changes substantially as the structure is folded and unfolded, but the size of the outer perimeter changes relatively little.

24. A reversibly retractable truss structure according to claim 23, where a covering is provided by attaching plates to the elements of the loop-assemblies that comprise the structure.

* * * * *